United States Patent [19]

Grimble et al.

[11] 4,164,361

[45] Aug. 14, 1979

[54] DEEP-FREEZE CABINET WITH TRANSPARENT CLOSURE

[75] Inventors: Brian J. Grimble, Baldock; Michael R. Rouse, Dunstable, both of England

[73] Assignee: Imperial Chemical Industries Limited, London, England

[21] Appl. No.: 828,606

[22] Filed: Aug. 29, 1977

Related U.S. Application Data

[63] Continuation-in-part of Ser. No. 747,382, Dec. 3, 1976, abandoned.

[30] Foreign Application Priority Data

Sep. 17, 1976 [GB] United Kingdom ..... 38586/76

[51] Int. Cl.[2] ..... A47B 77/08; A47F 3/04

[52] U.S. Cl. ..... 312/236; 312/116; 312/214; 49/501

[58] Field of Search ..... 312/236, 239, 214, 296, 312/116, 138 A; 52/308; 49/501

[56] References Cited

U.S. PATENT DOCUMENTS

| | | | |
|---|---|---|---|
| 1,124,778 | 1/1915 | Meuler | 52/308 |
| 1,807,332 | 5/1931 | Abrahamson | 312/116 |
| 1,963,089 | 6/1934 | Henderson | 312/116 |
| 2,301,510 | 11/1942 | Bolen | 312/236 |
| 2,656,688 | 10/1953 | Hinkel | 312/236 |
| 3,130,288 | 4/1964 | Monaco et al. | 312/214 |
| 3,294,462 | 12/1966 | Kesling | 312/214 |
| 3,418,755 | 12/1968 | DiChiaro | 49/501 |
| 3,717,395 | 2/1973 | Spielvogel et al. | 312/114 |
| 3,729,243 | 4/1973 | Musgrave et al. | 312/116 |
| 4,004,388 | 1/1977 | Stefanik | 52/308 |

*Primary Examiner*—Victor N. Sakran

*Attorney, Agent, or Firm*—Cushman, Darby & Cushman

[57] ABSTRACT

A deep-freeze cabinet provided with a closure comprising a pair of transparent, rigid sheets of a thermoplastic material which are bonded to each other and form a sealed double-walled enclosure having a peripheral flange. The closure may be contained in a surrounding metal frame or, preferably, is frameless with securing means, for attaching the closure to hinges on the deep-freeze cabinet, passing through spaced walls of the enclosure.

9 Claims, 2 Drawing Figures

DEEP-FREEZE CABINET WITH TRANSPARENT CLOSURE

This application is a continuation-in-ppart of Application Ser. No. 747,382, filed 3 Dec. 1976 now abandoned.

This invention relates to a transparent closure for a deep-freeze cabinet formed from thermoplastic materials.

The use of deep-freeze cabinets for storage of foodstuffs in the home has gained rapid acceptance over the past few years. These cabinets operate so that the foodstuffs are stored at temperatures of less than −10° C. and preferably less than −15° C. To maintain this large temperature differential between the operating temperature and ambient temperature requires a considerable consumption of electrical energy. Although they are used to a limited extent for in situ freezing of fresh foodstuffs such as home-grown vegetables, the majority of the foodstuffs stored are bought as pre-packed ready-frozen commodities from shops specialising in the sale of frozen goods. These shops usually referred to as freezer centres normally display the goods in the conventional domestic freezers of the chest-type comprising an insulated cabinet and a hinged lid on top of the cabinet. In order to examine the contents of the normal domestic freezer the lid must be raised and in order to maximise sales and give an effective presentation of the goods to the customer it has been the practice to leave the lids in an open position. More recently the increasing costs of electricity have made this practice expensive because the heat losses under these conditions are very significantly increased over the cost of running a normally closed freezer. An attempt has been made to reduce running costs at the same time as providing a readily visible display of the freezer contents by using lids made from single sheets of transparent thermoplastic. These have been partially successful in reducing running costs but the visibility has been impaired by the formation of condensation on the underside of the lid arising from the large temperature differential between the lid and the contents of the freezer. A freezer lid has now been devised which substantially overcomes these problems.

Accordingly there is provided a deep-freeze cabinet having a closure formed from a pair of transparent rigid sheets of a thermoplastic material which are bonded together at their perimeters to form a peripheral flange bounding a double-walled enclosure.

The invention also provides a transparent, doublewalled closure for a deep-freeze cabinet comprising a pair of rigid thermoplastic sheets of a thermoplastic material which are bonded together at their perimeters to form a peripheral flange bounding a double-walled enclosure. Preferably, the walls of the closure are separated from each other by a distance of at least 10 mm over a major proportion of their area. In the simplest form one of the sheets forming the enclosure is substantially flat and is bonded at its periphery to the periphery of a second sheet of dish shape of suitable dimensions. Alternatively, the enclosure may be formed from two shaped sheets bonded at their peripheries, the shapings being such that an inner shaped sheet is accommodated within the space formed by an outer shaped sheet and the bonded peripheries forming a flat base portion.

The use of the invention gives a much greater saving in running costs than a lid formed from a single sheet of transparent plastics and greatly improves the visibility problem because condensation is substantially reduced. The excellent visibility enables the contents of a freezer cabinet to be checked at a glance by both the customer and the shop staff for restocking purposes. Unnecessary opening of the lid and consequent increases in running costs are thereby reduced to a minumum.

Preferably the closure is formed so that the pair of sheets are disposed in an essentially parallel relation to each other being separated by a sufficient distance to provide good heat-insulating properties. In general, optimum performance is obtained at a separation between 10 mm and 40 mm, preferably 15 to 30 mm.

The double-walled closure may be attached to the cold storage cabinet by any suitable hinge to permit the closure to be readily opened and closed. The hinge is conveniently attached to the flange of the sealed closure. Preferably the edge of the sealed closure is completely surrounded by a metal frame so that risk of damage at the edges of the enclosure is minimised and the hinge is attached to the metal frame.

Alternatively, suitable closures have been devised which dispense with the need to surround the sealed edge of the closure with a metal frame. Surprisingly the double skin of the enclosure provides a sufficiently rigid structure to dispense with the metal surround enabling the cost of the closure to be significantly reduced. When the metal surround is not used it is preferred to attach the hinge to the closure by securing means which pass through the walls of the double-walled enclosure rather than through the flanged surround. In such an arrangement provision should be made so that the separated walls are subjected to little or no strain by the securing means. This is readily provided for by including blocks of material which fill the gap between the walls and prevent relative movement of the walls when the securing means is tightened.

Accordingly there is further provided a deep-freeze cabinet having a closure comprising inner and outer shaped, transparent thermoplastic sheets which are spaced apart from each other over a major part of their surface area, the peripheries of the sheets being bonded together to form a peripheral base portion, having inner and outer spaced, circumferential walls extending from the peripheral base portion and reinforcing blocks fixed between the circumferential walls capable of receiving securing means for attaching the closure to hinges provided on the deep-freeze cabinet. For convenience, such a double-walled closure is formed so that the walls through which the hinge is attached are parallel and are perpendicular to the flange. Other configurations are possible with suitably designed reinforcing blocks and spacers.

The hinge used may be of the spring-loaded type but the relative low weight of the closure according to the invention compared with conventional closures for cold storage cabinets allows less expensive, lighter duty hinges to be used.

Suitable double-walled, flanged enclosures may be constructed according to methods known in the art. A method suitable for semi-automatic large scale production of some forms of such units is described in British patent specification No. 1,384,885. In a method described therein a pair of thermoplastics sheets, one of which is provided with an aperture, are heated to soften the sheets prior to clamping the sheets together, stretching the unapertured sheet away from the apertured sheet using pressure or vacuum until the stretched sheet makes contact with a supporting rim and subsequently rapidly equalising the pressures on either side of the stretched portion of the sheet to bring the stretched portion into a substantially parallel relationship to the unstretched sheet. Preferably, before heating, the areas of the sheets which will be brought into mutual contact by the clamping operation are provided with an adhesive which is activated by heat or pressure. When the thermoplastic sheets are composed of poly(methyl methacrylate) a very satisfactory bond is obtained by using a solution of low molecular weight poly(methyl methacrylate) in methyl methacrylate monomer. This may be applied to the areas of the sheets over which mutual bonding is required and allowed to dry to a non-tacky film. When the sheets are heat-softened and clamped together a very effective bond is formed.

Any alternative method of forming the flanged enclosure may be used. For example, the enclosure may be formed by first shaping a single sheet by conventional thermoforming techniques to give a dish-shaped article having a planar surface surrounded by a flange and subsequently cementing a second flat sheet to the flange so that a sealed enclosure having essentially parallel planar walls is formed. British patent specification No. 1,414,747 describes a particular method of forming a double-walled window suitable for a caravan. The method described can be adapted for making closures according to the present invention.

At least one of the sheets forming the closures may be additionally shaped to provide an integral handle or finger-hold for the closure.

The invention is now illustrated with reference to the accompanying drawings.

FIG. 2 shows a further embodiment in which the hinge of the deep-freeze cabinet is fixed to the closure through the spaced walls and the metal surround is dispensed with.

Figure 1:
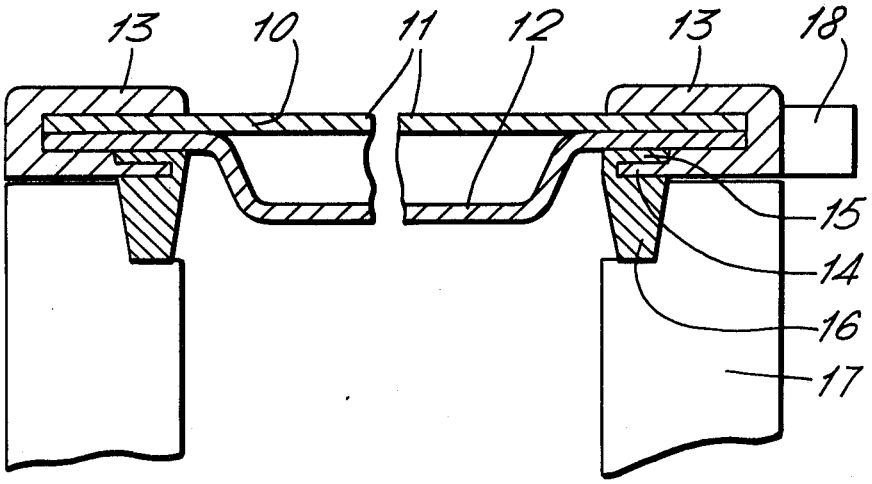
FIG. 1 shows a cross-sectional view through a closure according to the invention forming the lid of a chest-type deep-freeze cabinet in which a closure according to the invention is provided with a metal surround.

In FIG. 1 a double-walled unit, generally represented by 10, made from a pair of sheets 11 and 12 of poly(methyl methacrylate) according to the method described in British patent specification No. 1,384,885 is contained by a metal frame 13 surrounding the edge of the double-walled unit. The metal frame 13 is generally of U-shaped section but is formed with a recessed shoulder 14 for accommodating a fixing strip 15 of a flexible sealing member 16. The flexible sealing member 16 is positioned so as to form a seal with the wall 17 of a deep-freeze cabinet when the lid is in the closed position. The metal frame 13 is provided with substantial metal blocks 18 along one side of the frame so that a spring-loaded hinge (not shown) attached to a cold storage cabinet may be secured to the framed lid.

Figure 2:
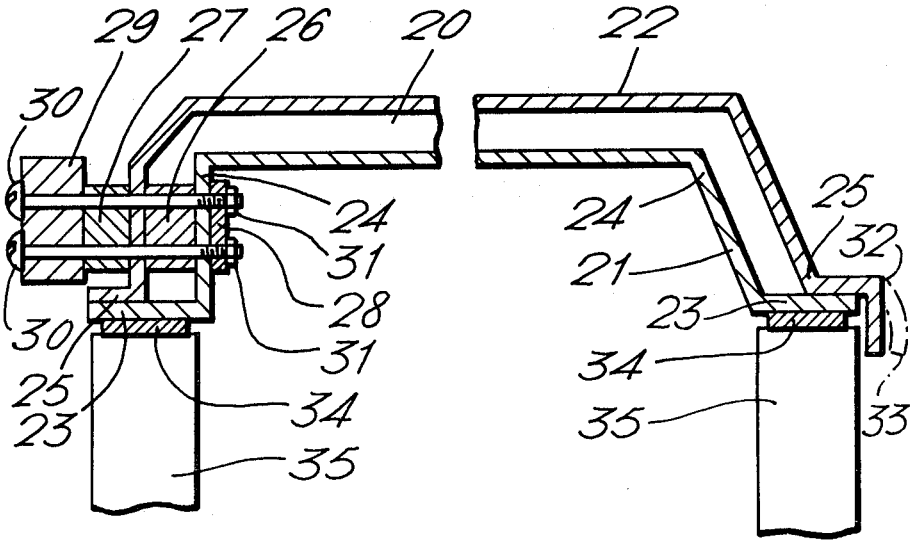

In FIG. 2 a double-walled unit generally represented by 20, made by separately forming a pair of sheets 21 and 22 of poly(methyl methacrylate) and subsequently cementing them together to form a flanged portion 23 from which extend inner and outer spaced circumferential walls, 24 and 25 respectively. Reinforcing blocks 26 of polymethyl methacrylate are provided to fill the gap between that portion of the walls to which the hinge is to be secured. The blocks 26 are introduced between the walls during construction of the double-walled enclosure. A spacer plate 27 and a straining plate 28 are positioned either side of the double-walled enclosure, in alignment with the reinforcing block. The assembly is attached to an aluminium block 29, which forms part of a hinge system fixed to the freezer cabinet (not shown), by bolts 30 passing through bores provided through the aluminium block aligned with bores passing through the spacer plate 27, reinforcing block 26 and straining plate 28 respectively and secured with nuts 31. Sheet 22 is provided with an overhang 32 on the side of the closure opposite to that attached to the hinges. The overhang 32 is provided mid-way along its length with a lip 33 to act as a finger-hold when the lid is to be lifted or lowered. A sealing gasket 34 is adhered to the flange portion 23 of the closure to make sealing contact with the upper surface of a wall 35 of a deep-freeze cabinet.

Whilst the closures of the invention are particularly suitable for providing lids for deep-freeze cabinets of the chest-type the invention is not limited to such lids and may also be used for the doors of the upright type of freezer. Closures according to the invention are suitable for any size of normally available deep-freeze cabinet which typically may have opening dimensions varying from about 60 to 120 cm in width and from about 120 to 240 cm in length.

The thermoplastic material most suitable for the present invention is poly(methyl methacrylate) because of its excellent clarity, good impact strength and resistance to scratching. Minor proportions of comonomers may be present with the methyl methacrylate. Other transparent thermoplastic materials which may be used include polymers and copolymers of vinyl chloride, polymers and copolymers of styrene, polycarbonates and cellulose acetate butyrate. The surface hardness of these materials particularly poly(methyl methacrylate) are suitable to withstand normal usage but occasional polishing may be necessary to remove scratches. Alternatively, the hardness of the surface may be improved by using surface treatments which provide abrasion resistance and which are known in the art.

We claim:

1. A deep freeze cabinet having a closure formed from inner and outer transparent rigid shaped sheets of a thermoplastic material, the inner sheet being accommodated in the space formed by the outer sheet and the sheets being bonded together at their perimeters to form a flat peripheral flange bounding a double-walled enclosure in which the walls of the enclosure are essentially parallel to each other over a major proportion of their area and are separated by a distance of at least 10 mm and less than 40 mm, said flange sealing contacting an upper surface of the wall of the deep freeze cabinet so that the inner shaped sheet is positioned outside the interior of the deep freeze cabinet.

2. A deep freeze cabinet according to claim 1 in which the closure is contained within a surrounding frame.

3. A deep freeze cabinet according to claim 1 having a closure comprising inner and outer shaped, transparent thermoplastic sheets which are spaced apart from each other over a major part of their surface area, the peripheries of the sheets being bonded together to form a peripheral base portion, having inner and outer spaced, circumferential walls extending from the peripheral base portion and reinforcing blocks fixed between the circumferential walls capable of receiving securing means for attaching the closure to hinges provided on the deep freeze cabinet.

4. A deep freeze cabinet according to claim 3 in which the inner and outer spaced walls extending from the peripheral base portion are parallel to each other and perpendicular to the base portion.

5. A deep freeze cabinet according to claim 3 in which the closure is secured to hinges on the deep freeze cabinet by bolts passing through the circumferential walls, the reinforcing blocks and plates disposed on the outside walls of the closure and aligned with the reinforcing blocks.

6. A deep freeze cabinet according to claim 3 in which at least one sheet of the closure is shaped to provide an integral handle on the closure.

7. A closure for a deep freeze cabinet comprising inner and outer shaped, transparent thermoplastic sheets which are spaced apart from each other over a major part of their surface area, the peripheries of the sheets being bonded together to form a peripheral base portion, having inner and outer spaced, circumferential walls extending from the peripheral base portion and reinforcing blocks fixed between the circumferential walls capable of receiving securing means for attaching the closure to hinges provided on the deep freeze cabinet.

8. A closure for an opening in a deep freeze cabinet comprising an inner and an outer transparent rigid sheet of a polymeric thermoplastic material, said sheets having continuous peripheral portions bonded directly to each other to form a continuous flat peripheral flange whereby said sheets form a double-walled enclosure, essentially all of the remainder of said sheets being spaced apart by a distance of at least 10 mm and less than 40 mm and being essentially parallel to each other and to said flange, said flange being free of any reinforcing surround and the inner surface of said flange adapted to sealingly and releasably engage the outer edge of the cabinet opening in a manner such that the inner sheet will be positioned outside the cabinet, and reinforcing blocks fixed between and in engagement with the spaced-apart portions of said sheets at locations near said flange for receiving securing means capable of attaching hinges.

9. A deep freeze cabinet of the chest type having the closure member of claim 8 sealingly and releasably engaging the outer edge of a vertically facing opening in the cabinet.

* * * * *